US005270474A

United States Patent [19]

Kun

[11] Patent Number: 5,270,474

[45] Date of Patent: Dec. 14, 1993

[54] VIOLIN OR THE LIKE SHOULDER REST

[76] Inventor: Joseph Kun, 200 MacLaren Street, Ottawa, Ontario, Canada, K2P 0L6

[21] Appl. No.: 679,062

[22] PCT Filed: Aug. 20, 1990

[86] PCT No.: PCT/CA90/00264

§ 371 Date: May 28, 1991

§ 102(e) Date: May 28, 1991

[87] PCT Pub. No.: WO91/05329

PCT Pub. Date: Apr. 18, 1991

[30] Foreign Application Priority Data

Sep. 26, 1989 [CA] Canada ..... 613387

[51] Int. Cl.[5] ..... G10D 1/02

[52] U.S. Cl. ..... 84/280

[58] Field of Search ..... 84/278, 280

[56] References Cited

U.S. PATENT DOCUMENTS 2,697,374 12/1954 Ungh ..... 84/278

3,631,754 1/1972 Kun ..... 84/278

4,333,378 6/1982 Hrdlicka ..... 84/280

FOREIGN PATENT DOCUMENTS 2659869 8/1977 Fed. Rep. of Germany .

395889 1/1974 U.S.S.R. .

2052828 1/1981 United Kingdom .

*Primary Examiner*—Michael L. Gellner

*Assistant Examiner*—Cassandra C. Spyrou

*Attorney, Agent, or Firm*—Stevens, Davis, Miller & Mosher

[57] ABSTRACT

A violin or the like shoulder rest is disclosed, wherein the transverse inclination of the elongated base (12, 61) relative to the clamping forks (15, 16, 93, 102) is limited to an angle of about 5° to about 25° to reduce the likelihood of damaging the instrument by inadvertently impacting the bottom of the violin with the edge of the base of the shoulder rest. A preferred embodiment provides the advantage of transfer of load forces from the clamping forks (93, 102) to the base (61) through bearing caps (89, 100) rather than by way of pivot pins (87, 88, 98, 99), to allow substantial reduction in size of the pivot pins. In a particularly preferred embodiment, rectangular blocks (82, 95) are pivotable each within a complementary cavity provided in the respective post at the end of the base.

11 Claims, 5 Drawing Sheets

VIOLIN OR THE LIKE SHOULDER REST

BACKGROUND OF THE INVENTION

The present invention relates to shoulder rests for use with violins, violas or the like instruments.

Shoulder rests of this type are useful in increasing the comfort of proper holding of the instrument by a player regardless of the physical build of the player such as the length of his neck and the configuration of his or her shoulders.

One of the adjustments provided for in quality shoulder rests is the adjustment of a transverse inclination of the underside of the shoulder rest with respect to the plane of coincidence with the bottom of the instrument. That is to say, adjustment of the particular position at which the neck of the instrument is held with respect to a horizontal line must be adjustable while assuring full contact between the underside of the base of the shoulder rest and the player's shoulder. This is achieved by providing a pivotal securement whereby clamping members engaging the sides of the violin are pivotable about a transverse axis parallel with the elongation of the base of the shoulder rest.

My U.S. Pat. No. 3,631,754, issued Jan. 4, 1972, DT-OS 26 59 869 A1 (Wolf) and SU-Patent 395,889 (Chevachov) present examples of the adjustability as mentioned.

One of the problems of this arrangement of adjustable transverse angle is in that an inadvertent slippage may occur during the adjusting of the shoulder rest resulting in an accidental tipping over of the base about the transverse axis and scratching of the bottom of the instrument by the edge of the base of the shoulder rest when the side engaging forks are being attached to the instrument.

It is an object of the present invention to further advance the art of shoulder rests of the type mentioned and in particular to reduce the possibility of damaging the particular instrument, while retaining the possibility of adjustment of the transverse inclination of the base of the shoulder rest.

In general terms, the present invention provides a shoulder rest for violin or the like musical instrument, of the type comprising an elongated base having an undersurface formed to conform to the shoulder of a person, a pair of clamping members secured to the base one at each end thereof, for clamping the shoulder rest to a respective violin or the like by engaging opposed side portions thereof; each clamping member including two spaced apart clamping elements complementary with side portions of a respective violin or the like and an intermediate support means disposed between the respective clamping elements for engaging bottom portion of the respective violin or the like, said support means being complementary with and defining a support plane;

clamping member securement means for securing the respective clamping member to the base, said clamping member securement means including a pivotal joint disposed between the clamping member and the base and allowing pivotal movement of the respective clamping member relative to the base about a longitudinal axis generally parallel with the elongation of the base to thus allow the adjustment of a transverse inclination of the undersurface relative to the support plane; and stop means operatively associated with the pivotal joint to limit said pivotal movement to an angle of from about 5° to about 25°.

BRIEF DESCRIPTION OF THE DRAWINGS

The invention will now be described in greater detail by way of preferred exemplary embodiments with reference to the accompanying diagrammatic, not-to-scale drawings, wherein.

DETAILED DESCRIPTION

Figure 5:
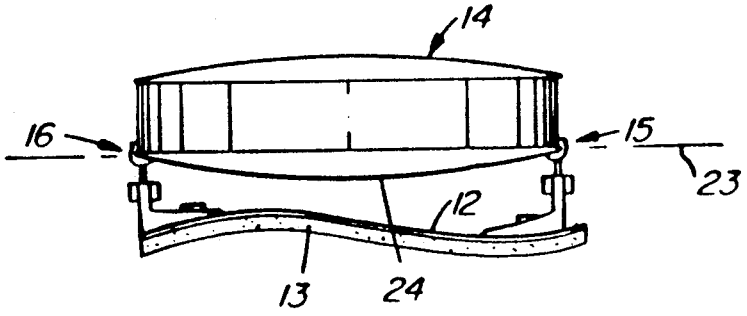
FIG. 5 (on the sheet of FIG. 1) is a diagrammatic end view of a violin showing how a shoulder rest is attached to an instrument.
Figure 1:
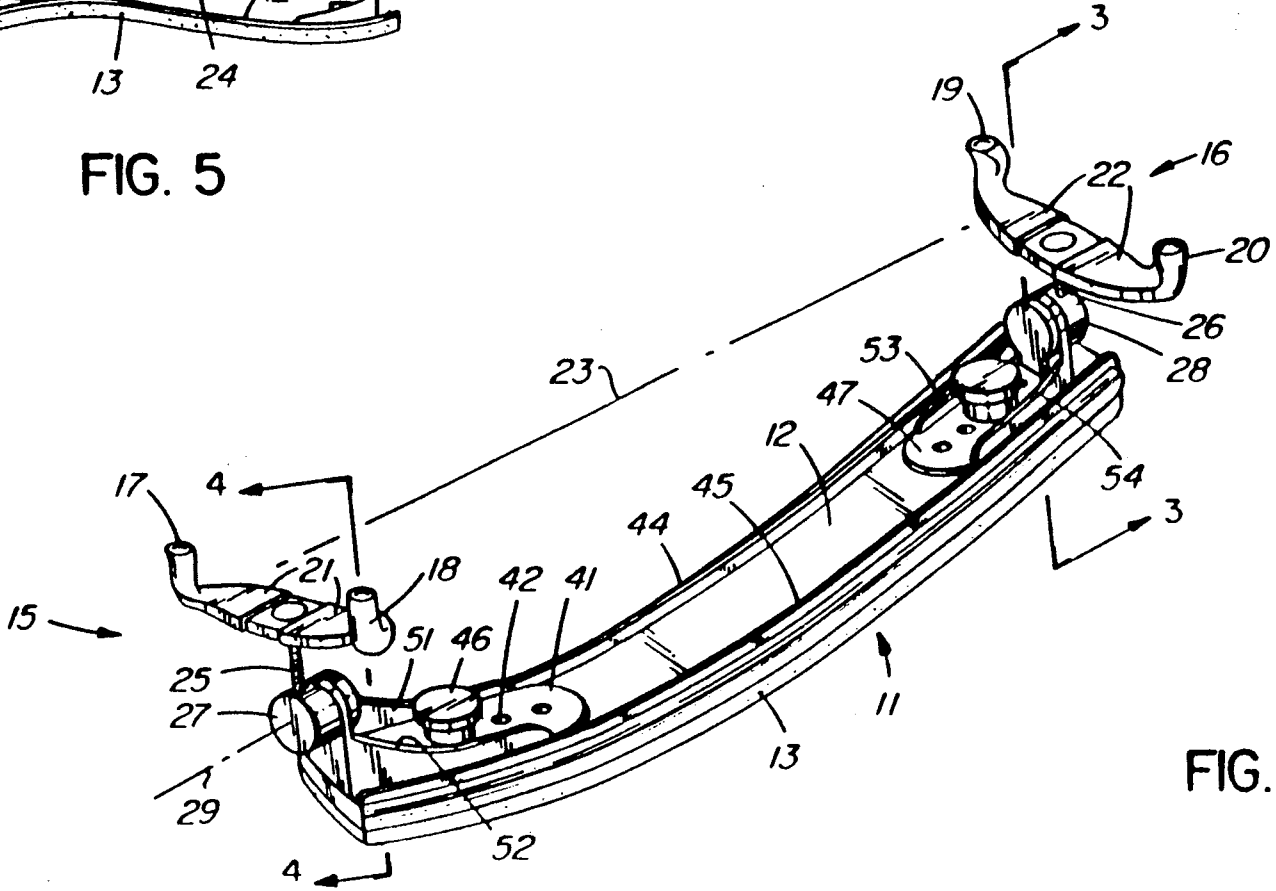
FIG. 1 is a simplified perspective view of one embodiment of my improved shoulder rest including the features of the invention.

The shoulder rest 11 of FIG. 1 comprises some components of my shoulder rest disclosed and claimed in U.S. Pat. No. 3,631,754. It comprises an elongated base 12 whose underside has a foam padding 13. As shown in FIG. 5, the base 11 is elongated generally transversely of a violin 14, when the shoulder rest is attached to the instrument. The underside has the shape of a very shallow curvature to conform to the shoulder of the user.

A pair of forks or clamping members 15, 16 is secured to the base, one at each end of the base 12. The forks 15, 16 clamp the sides of the respective violin 14 thus securing the shoulder rest 11 to the violin. As is known, the fork members comprise each a pair of fingers, also referred to as "clamping elements" 17, 18, 19 and 20. They are usually provided with a soft rubber overcoat to engage the side of the violin 14 without scratching or otherwise damaging its surface.

Each fork further comprises an intermediate support portion or intermediate support means 21, 22 disposed between the respective clamping elements 17–18, 19–20. It can be appreciated on review of FIGS. 1, 2 and 5 that the intermediate support means 21, 22 is coincident with a support plane 23 indicated, in FIG. 5, by a line which is in coincidence with the bottom 24 of the violin 14. Of course, the bottom of a violin is slightly convexly curved but for the purpose of explaining the present invention, it may be considered coplanar with the plane 23.

As is known, each fork 15, 16 is integral with a threaded stem 25, 26 received in a respective side member 27, 28. Thus, the forks 15, 16 are pivotable about a normally vertical axis to self-centre the fingers 17, 18 against the side of the violin 14 and at the same time to allow adjustment in the vertical spacing of the forks 15, 16, from the base 12 i.e. of the distance of the support plane 23 from the base 12. The side members 27, 28 are each pivotable about a longitudinal axis 29, 30. The longitudinal axes 29, 30 are generally parallel with the support plane 23 and with the elongation of the base 12.

Figure 2:
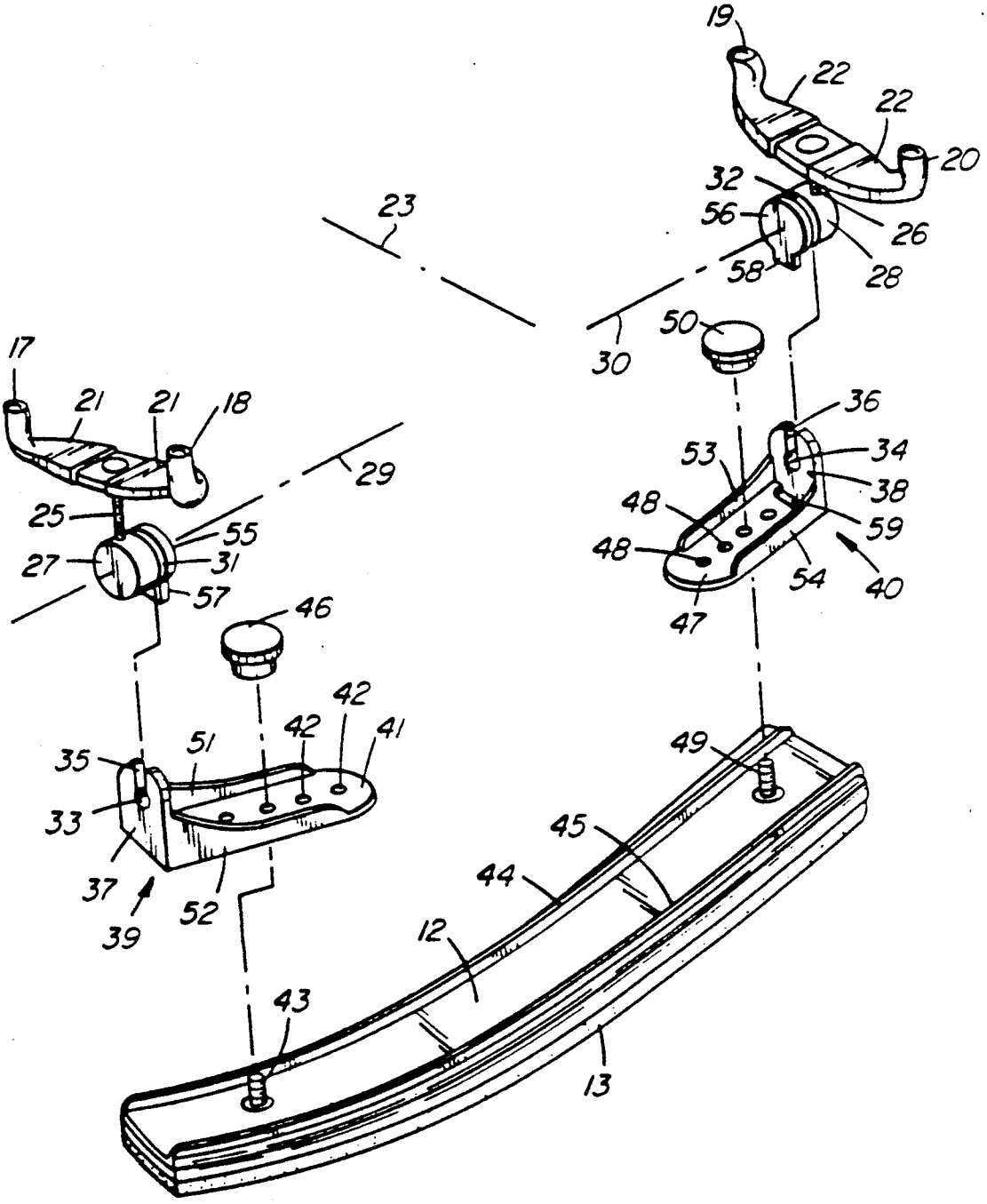
FIG. 2 is an exploded perspective view of the shoulder rest of FIG. 1.

Each side member 28, 29 has a pivot pin, not visible in the drawings views of FIGS. 1 or 2. It is indicated in broken lines of FIG. 3 and referred to with reference letter P. The pin P is integral with, and located centrally of, the respective side member 27, 28, extending across a narrow, deep peripheral slot 31, 32. The pivot P is compatible with a bearing hole 33, 34 forming the lower end of the respective vertical slot 35, 36 open on top and made in an upright arm 37, 38 of the related L-shaped connector 39, 40. The upright arm 37, 38 is also referred to as a "second arm".

A normally generally horizontal first arm 41 of the L-shaped connector 39 is provided with a row of passages 42 complementary with a threaded anchor pin 43 fixedly secured to the base 12. The width of the horizontal arm 41 is designed to allow free displacement of the arm 41 between two reinforcement ribs 44, 45. The securement of the arm 41 takes place by a thumb nut 46 complementary with the threaded pin 43. Likewise, the opposed L-shaped connector 40 has a horizontal (or "first arm") 47 provided with a row of passages 48, for securement by an associated threaded anchor pin 49 and the respective thumb nut 50.

Thus, the L-shaped members 39, 40 can be secured to the base 12 at a predetermined spacing between the upright (or "second") arms 37, 38 thus determining the spacing between the forks 15, 16 which depends on the size of the violin, viola or the like, to which the shoulder rest is to be attached.

The horizontal arm 41 has a pair of opposed side walls 51, 52 and the horizontal arm 47 has a pair of opposed side walls 53 and 54. In other words, a substantial part of each horizontal arm 41, 47 is channel-shaped.

Figure 3:
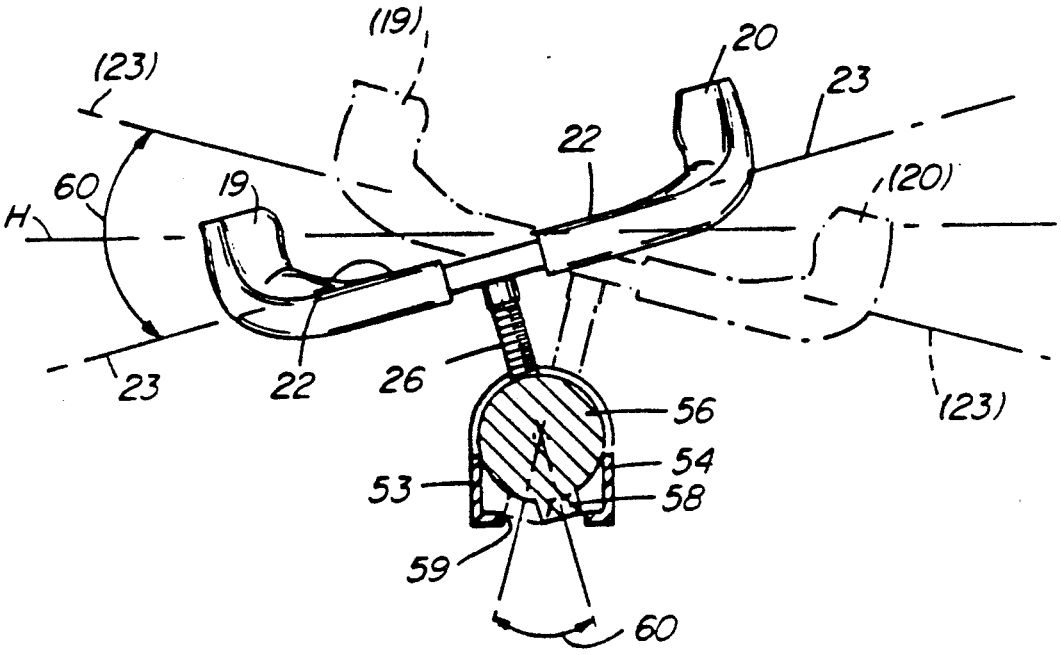
FIG. 3 is section 3—3 of FIG. 1.

As best seen from FIG. 2, each side member 27, 28 has an integral, inwardly directed face portion 55, 56. The face portions 55, 56 are each generally disc-shaped except for a respective small, downwardly directed radial projection 57, 58. A transverse slot 59 is made in the bottom of the horizontal arm 47. The length, thickness and width of the projection 58 is such that when the side member 29 is pushed with its pivot pin P into engagement with the bearing hole 34, the projection 58 is disposed within the slot 59, as shown in FIG. 3. The width of the projection 58 limits pivotal movement of the side member 28 about the axis 30 only to the extend of an angle 60 between the extreme positions of the plane 23 as indicated in broken lines of FIG. 3.

The downwardly directed radial projection 57 of the opposed side member 28 is wider than projection 58 as it engages the side walls 51, 52 of the channel-shaped horizontal arm 41 of the L-shaped member 39. The angle 60 of limitation is the same as in the opposed side member 28.

Thus, both embodiments of the stop means have, in general terms, a radial projection which can engage, with its free lower end portion one of opposed stop surfaces i.e. either the ends of the slot 59 or one of the inner surface of side walls or flanges 51, 52.

Figure 4:
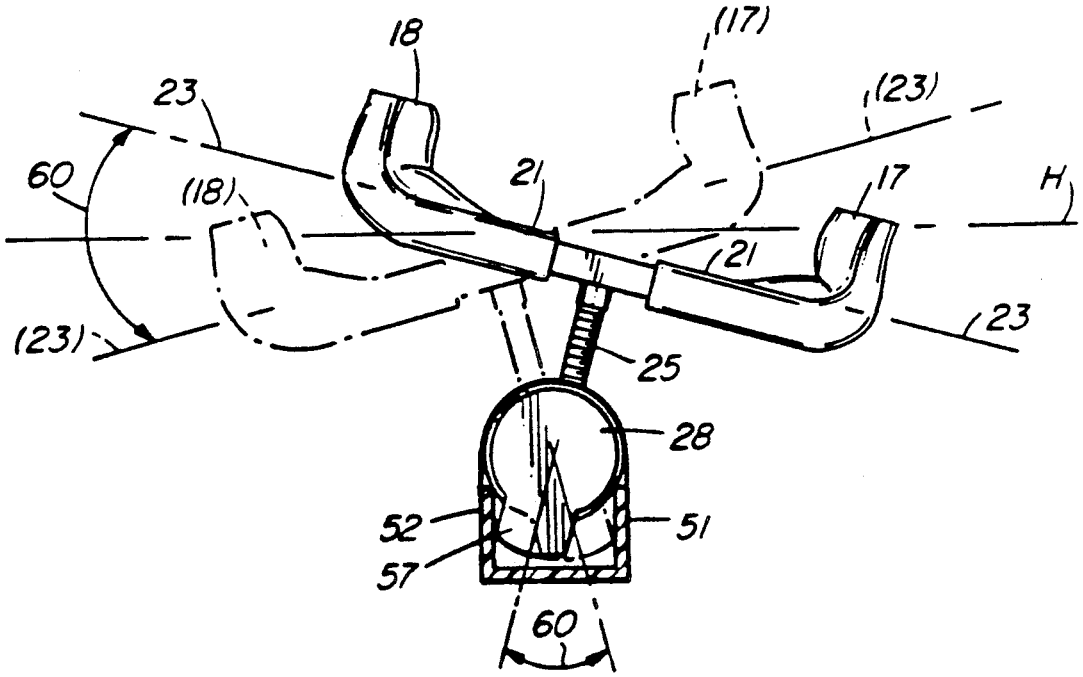
FIG. 4 is section 4—4 of FIG. 1.

It is one of the features of the present invention that the angle 60 not only has a predetermined maximum but also is particularly disposed relative to a normally horizontal plane H. The maximum of the angle 60 is about 25°. The angle determines the limits of the transverse inclinations indicated in FIGS. 3 and 4 which actually correspond to the transverse inclination of the underside of the padding 13 with respect to the plane 23. The angle 60 must be at least 5° in order to enable reasonable adjustment of the longitudinal inclination of the instrument. The normally horizontal plane H (FIGS. 3, 4) designates zero transverse inclination. The horizontal plane H is located within the extremes of the angle 60.

Another embodiment of the present invention is shown in FIGS. 6–10.

Figure 11:
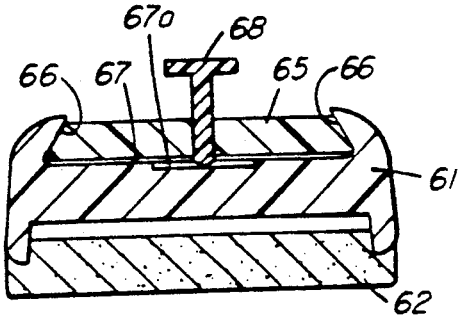
FIG. 11 (on the sheet of FIG. 6) is section 11—11 of FIG. 6.
Figure 6:
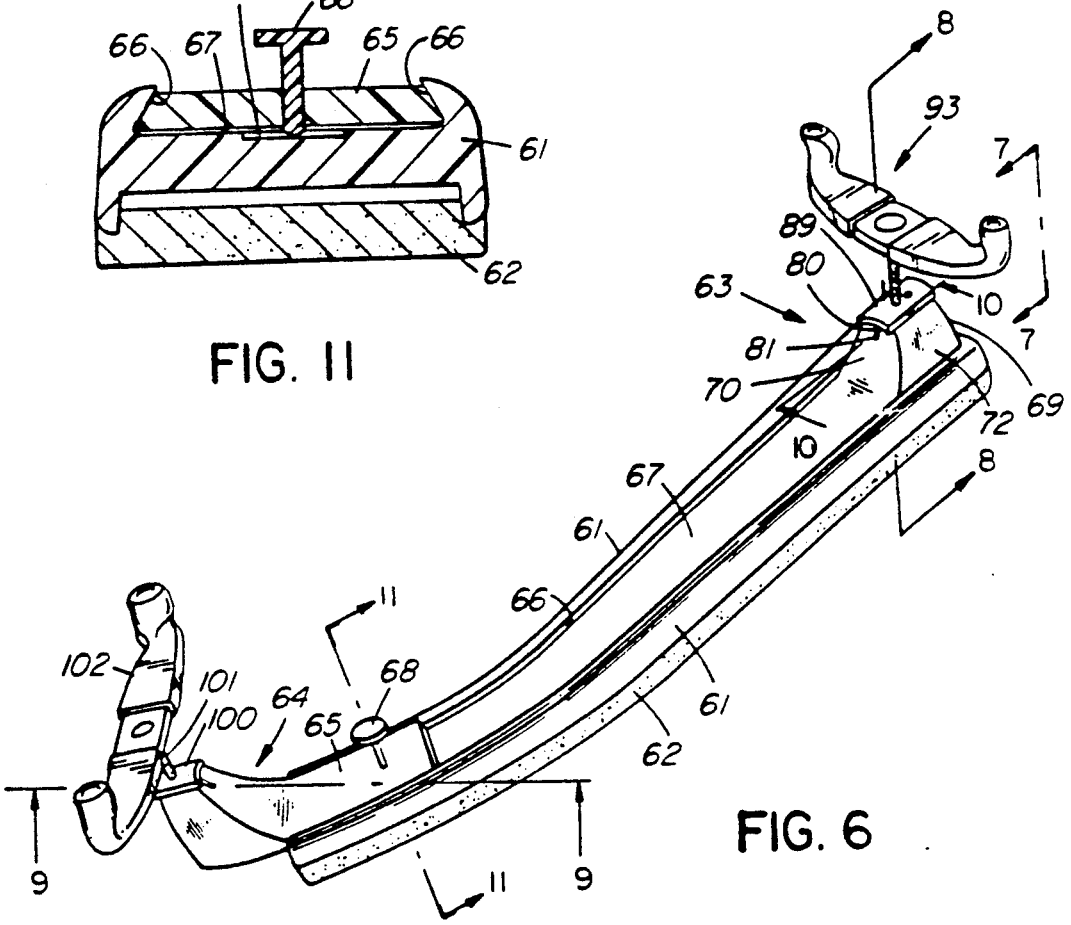
FIG. 6 is a perspective view similar to that of FIG. 1 but showing another embodiment of the invention.

A base 61 is molded from suitable plastic material such as a mixture of nylon and glass fibre. The base 61 is provided with a resilient foam underside 62 which forms the padding of the shoulder rest engaging the player's shoulder. The base 61 is molded integral with a hollow post 63. Another hollow post 64 is adjustably secured to the opposite end of the base 61. The post 64 forms a normally upright portion of an L-shaped member. The normally horizontal, first arm 65 thereof is slidably received in a dovetail shaped shallow groove 66 having a bottom 67, which is flat except for a series of short transverse ribs 67*a* of which one is visible in FIG. 11. There is provided a fixing thumb screw 68 whose lower free end passes through the horizontal arm 65 and engages a groove between two of the ribs 67*a* to lock the L-shaped member at a suitable spacing between the clamping forks shown in FIG. 6. The side walls of the groove 66 converge in the direction upwardly away from the bottom 67 as best seen in FIG. 11.

Figure 7:
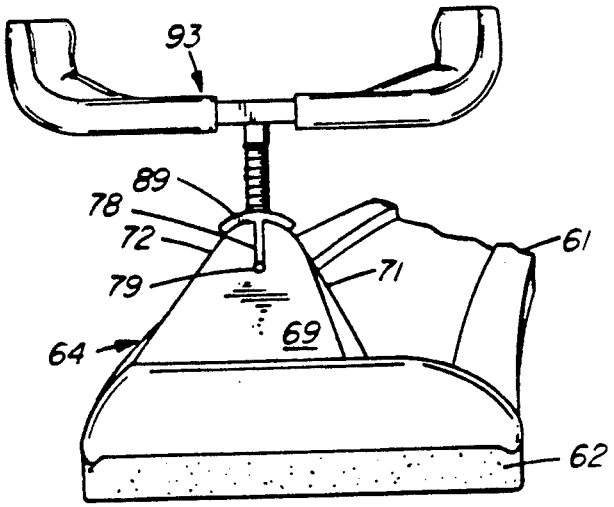
FIG. 7 is an end view in direction 7—7 of FIG. 6.
Figure 8:
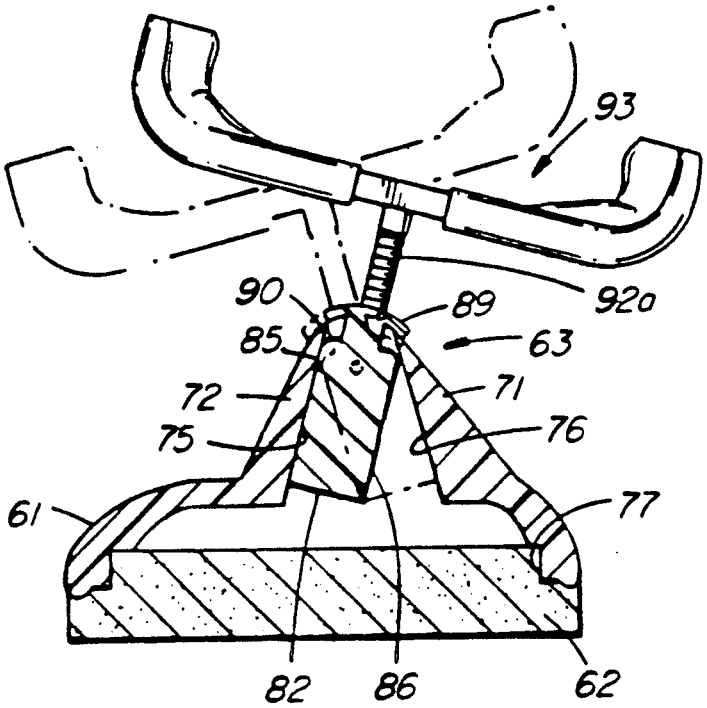
FIG. 8 is section 8—8 of FIG. 6.
Figure 9:
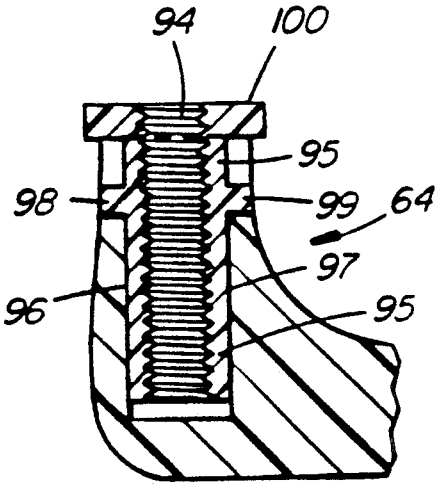
FIG. 9 is a partial section 9—9 of FIG. 6 with certain parts shown in FIG. 6 having been omitted from FIG. 9.
Figure 10:
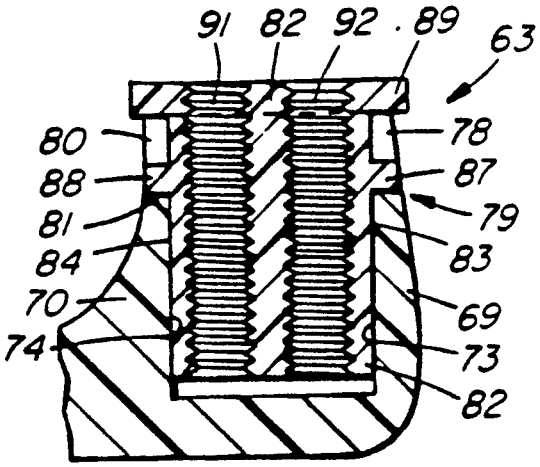
FIG. 10 is a partial section 10—10 of FIG. 6 with certain parts shown in FIG. 6 omitted from FIG. 10.

The structure of the two hollow posts 63, 64 is generally identical and will now be described in detail with reference to post 63 as shown in FIGS. 7, 8 and 10. The post 63 has an outer end wall 69, an opposed inner end wall 70 and a pair of side walls 71 and 72. The four walls limit an upwardly open cavity of which a first transverse surface 73 of end wall 69 is seen in FIG. 10 together with the opposed second transverse surface 74 of end wall 70. The remaining two opposed surfaces defining the cavity are first and second longitudinal surfaces 75, 76 of side walls 72, 71, respectively, seen in FIG. 8. The cavity is open on top. It communicates, at the bottom, with a depression 77 in which is adhesively secured the underpadding 62. FIG. 10 shows that the transverse surfaces 73, 74 of outside and inside walls 69, 70 face each other. They are generally planar and parallel with each other.

The outer wall 69 is provided with an upwardly open vertical slot 78 having a slightly enlarged, rounded bottom end portion 79. Similarly, the inside end wall 70 has an upwardly open slot 80 with a rounded bottom end portion 81 which is coaxial with and has the same diameter as the rounded end portion 79.

Disposed within the cavity of the post 63 is a block 82 the shape of which is apparent from FIGS. 8 and 10. The block 82 has the general shape of a rectangular prism. A first end wall 83 of the block 82 is in frictional engagement with the first transverse surface 73. The opposed, second end wall 84 of the block 82 is in frictional engagement with the second transverse surface 74. The degree of frictional resistance is given by mutual size of the block relative to the cavity and is selected to provide a degree of resistance to free pivoting of the block in the cavity but not to entirely prevent such movement.

As shown in FIG. 8, the first side wall 85 of the block 82 is adapted to abut against the first longitudinal surface 75. The opposite second side wall 86 of the block 82 can abut against the second longitudinal surface 76, when the block 82 is pivoted about the longitudinal axis of its pivot pins 87, 88 which are pivotally received within the respective rounded bottom end portions 79, 81 of the slots 78, 80. The size of the pivot pins 87, 88 with respect to the size of the slots 78, 80 is selected such as to allow forced passage of the pins along the respective slot to the associated rounded end portion 79, 81 as the block 82 is mounted in the cavity of the post 63. Typically, the width of the slot at the open top is about 1.45 mm. It narrows down to about 1.37 mm at the transition to the rounded end portion 79. The rounded end portion 79 and the pins 87, 88, 89, 99 have both a diameter of about 1.40 mm. The block 82 can also be placed in the cavity with the position of pins 87, 88 reversed.

The top of the block 82 is provided with a bearing cap 89 the underside of which is concavely curved to conform with the convexly rounded top surface 90 of the post 63. The curvature of the surface 90 is generally concentric with the axis of the rounded end portions 79, 81 and thus of the pivot pins 87, 88. As best seen in FIG. 10, the cap 89 covers the upper opening of the cavity in the post 63 at any position of the block 82 relative to the post 63. The cap 89 carries virtually all of the load transmitted to the base during the use of the shoulder rest as will be explained later, while the pins 87, 88 serve only to guide the pivoting and to prevent the block from falling out of the cavity.

Two parallel threaded passages 91, 92 are provided in the block 82. They are complementary with the thread of a threaded stem 92*a* of an associated clamping fork 93 whose structure is identical with that of the fork 15 or 16 and therefore does not have to be described again. It can be readily appreciated that the distance between the clamping forks of the shoulder rest depends, among others, on the selection of passage 91, 92 in which the respective stem is threaded.

The arrangement of the post 64 at the opposite end of the shoulder rest is virtually identical with that described above with one difference: there is only a single threaded passage 94 which results in a smaller length of the block. Otherwise, like the block 82, the block 95 has a first and second end wall 96, 97, two side walls (not shown in the drawings), a pair of pivot pins 98, 99, a bearing cap 100 and an associated threaded stem 101 of a clamping fork 102.

The second embodiment facilitates the mounting of the blocks in and from the requisite post cavities as the block is just positioned with its pivot pins 87, 88, 98, 99 along the associated slots such as slots 78, 80 and pushed in until the pins rest pivotally in the respective rounded end portions at the bottom of each slot. The respective bearing cap 89, 100 is now in contact with the convexly rounded top of the respective post. Thus, any pressure generated during the use of the shoulder rest as it is held by a player's chin, along the axis of the threaded stems 80, 101, is transmitted to the base 61 through the bearing caps 89, 100 and posts 63, 64. The pivot pin 87, 88, 98, 99 are not instrumental in this respect. Their size can thus be reduced which has beneficial effect on the overall appearance of the shoulder rest. The task of limitation of the transverse inclination is effected by the abutment of the blocks 82, 95 against the respective inside walls of the cavity as indicated in FIG. 8.

Those skilled in the art will appreciate from the above that the present invention can be carried out by way of many other embodiments which may differ to a greater or lesser degree from the above embodiments, without departing from the invention. Strictly as one of many examples, the openings 91, 92 of block 82 in FIG. 10 could be offset, one closer to and the other away from a vertical line of symmetry of the block 82 in FIG. 10, to obtain four different spacing portions of the openings 91, 92 from the opening 94, depending on how the block 82 is placed in the cavity as the pins 87, 88 are each compatible with either slot 78, 80. Accordingly, I wish to secure by letters patent which may issue on this application all such embodiments as reasonably and properly fall within the scope of my contribution to the art.

I claim:

1. A shoulder rest for a violin or viola, comprising an elongated base having an underside and two opposed ends, said elongated base being formed to conform to a user's shoulder, a pair of clamping members secured to the base, one at each of said ends thereof, for clamping the shoulder rest to a respective violin or viola by engaging opposed side portions thereof; each of said clamping members including two spaced apart clamping elements complementary with side portions of the respective violin or viola and an intermediate support means disposed between the clamping elements of each of said clamping members, for engaging a bottom portion of the respective violin or viola, said intermediate support means being complementary with and defining a support plane; clamping member securement means for securing a respective one of the clamping members to the base, said clamping member securement means including a pivotal joint disposed between each of said clamping members and the base and allowing pivotal movement of the respective one of the clamping members relative to the base about a longitudinal axis generally parallel with an elongation of the base to thus allow adjustment of a transverse inclination of the underside relative to the support plane, the shoulder rest further comprising stop means operatively associated with the pivotal joint to limit said pivotal movement in both a clockwise and a counter-clockwise direction, characterized in that the stop means is adapted to limit pivotal movement to an angle of a range of about 5° to about 25°, said range of about 5° to about 25° being so disposed relative to said underside and said support plane that, when the underside and the support plane are generally parallel to each other, the support plane is disposed within said range of about 5° to about 25°, whereby a maximum pivotal movement of the underside relative to the support plane is 25° or less.

2. A shoulder rest as recited in claim 1, characterized in that said securement means includes a generally L-shaped connector member whose first arm is adapted to become fixedly secured to the base at a respective one of said ends thereof, and whose second arm supports said pivotal joint, the pivotal joint including a pivot member provided with a radial projection having a free end portion disposed between a pair of opposed stop surfaces provided on said first arm.

3. A shoulder rest as recited in claim 2, characterized in that the opposed stop surfaces are ends of a transverse slot in the first arm.

4. A shoulder rest as recited in claim 2, characterized in that the first arm includes an outer channel-shaped portion including two upstanding flanges, said stop surfaces being inside surfaces of said flanges.

5. A shoulder rest as recited in claim 1, characterized in that said securement means includes a pair of threaded stems; each of said threaded stems generally integral with a respective one of said clamping members and protruding toward the base generally at right angles to the support plane by each of said stems being threaded in a respective block and being pivotally secured to an end member for pivoting relative thereto about a respective longitudinal axis within an opening in a respective hollow first post or second post, each of said first and second posts upstanding from the base at a respective one of said ends of the base and being fixed thereto, said opening having opposed stop surfaces adapted to engage associated surface portions of the respective block to limit pivotal movement of the respective block relative to a respective one of said posts within said angle.

6. A shoulder rest as recited in claim 5, characterized in that the respective block is pivotally secured to the respective one of said posts by a pair of respective pivot pins protruding from and integral with opposed end walls of the respective block and received at an end portion bottom of upright slots provided one in each of said opposed end walls of the respective post and open on top.

7. A shoulder rest as recited in claim 6, characterized in that a normally upper end remote from the base of the respective one of said posts comprises a convexly curved top surface, whose curvature is generally coaxial with the pair of respective pivot pins, said respective block further comprising a concavely curved bearing cap near a normally upper end of the respective block, the bearing cap being in sliding engagement with the respective curved top surface to supplementally support the respective block in the respective post in addition to the support afforded by the respective pivot pins.

8. A shoulder rest as recited in claim 6, characterized in that the first post is integral with the base and the second post forms one arm of a generally L-shaped member whose other arm is fixedly and adjustably mounted to the base for adjustment of the distance between the posts of the shoulder rest.

9. A shoulder rest as recited in claim 6, characterized in that the first post is integral with the base and the second post forms one arm of a generally L-shaped member whose other arm is fixedly and adjustably mounted to the base for adjustment of the distance between the posts of the shoulder rest, the block associated with the first post being provided with two internal threaded holes; each of said holes complementary with threads of a respective one of said threaded stems, the two threaded holes being generally parallel with each other and spaced from each other in a direction longitudinally of the base, whereby the spacing can be roughly adjusted by threading the respective one of said stems into a selected one of the two threaded holes.

10. A shoulder rest as recited in claim 7, characterized in that the first post is integral with the base and the second post forms one arm of a generally L-shaped member whose other arm is fixedly and adjustably mounted to the base for adjustment of the distance between the posts of the shoulder rest.

11. A shoulder rest as recited in claim 7, characterized in that the first post is integral with the base and the second post forms one arm of a generally L-shaped member whose other arm is fixedly and adjustably mounted to the base for adjustment of the distance between the posts of the shoulder rest, the respective block being provided with two internal threaded holes; each of said internal threaded holes complementary with threads of a respective one of said threaded stems the two threaded holes being generally parallel with each other and spaced from each other in a direction longitudinally of the base, whereby the spacing can be roughly adjusted by threading the respective one of said stems into a selected one of the two threaded holes.

* * * * *